US009798271B2

(12) United States Patent
Ino

(10) Patent No.: US 9,798,271 B2
(45) Date of Patent: Oct. 24, 2017

(54) IMAGE FORMING APPARATUS HAVING TONER STORING CONTAINER

(71) Applicant: Sharp Kabushiki Kaisha, Osaka (JP)

(72) Inventor: Toshiaki Ino, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/050,701

(22) Filed: Feb. 23, 2016

(65) Prior Publication Data

US 2016/0342112 A1 Nov. 24, 2016

(30) Foreign Application Priority Data

May 18, 2015 (JP) ..... 2015-101014

(51) Int. Cl.
*G03G 15/00* (2006.01)
*G03G 15/095* (2006.01)
*G03G 15/08* (2006.01)

(52) U.S. Cl.
CPC ..... *G03G 15/095* (2013.01); *G03G 15/0886* (2013.01); *G03G 15/0891* (2013.01); *G03G 15/0898* (2013.01)

(58) Field of Classification Search
CPC ..... G03G 15/095; G03G 15/0891; G03G 15/0863; G03G 15/0877; G03G 15/0865; G03G 15/0839; G03G 15/087; G03G 15/0875; G03G 15/0889; G03G 15/0855; G03G 15/0886; G03G 21/12; G03G 21/1676; G03G 2215/0695
See application file for complete search history.

(56) References Cited

U.S. PATENT DOCUMENTS 5,587,770 A 12/1996 Jo et al.
2009/0297178 A1* 12/2009 Kakuta ..... G03G 15/0844 399/27
2011/0064481 A1* 3/2011 Ishiguro ..... G03G 15/0875 399/263
2013/0094880 A1* 4/2013 Suzuki ..... G03G 15/0189 399/101

FOREIGN PATENT DOCUMENTS

JP 07-261537 A 10/1995

* cited by examiner

*Primary Examiner* — Walter L Lindsay, Jr.
*Assistant Examiner* — Jessica L Eley
(74) *Attorney, Agent, or Firm* — Renner, Otto, Boisselle & Sklar, LLP

(57) ABSTRACT

An image forming apparatus has a developing portion; a toner storing container; and a supply path capable of supplying toner to the developing portion from the toner storing container, where the toner storing container is attachably and detachably provided to the supply path, and the toner storing container has a screw-like conveying member configured to convey the toner; a discharge portion configured to discharge the toner toward the supply path; and a first cleaning member arranged at an end portion of the conveying member and configured to clean the discharge portion by scraping the toner on the discharge portion based on a rotation of the conveying member.

4 Claims, 10 Drawing Sheets

IMAGE FORMING APPARATUS HAVING TONER STORING CONTAINER

This Nonprovisional application claims priority under 35 U.S.C. §119(a) on Patent Application No. 2015-101014 filed in Japan on 18 May 2015, the entire contents of which are hereby incorporated by reference.

BACKGROUND OF THE INVENTION (1) Field of the Invention

The present invention relates to an image forming apparatus, such as a copier, a multifunction machine, a laser printer, facsimile machine or the like, for performing an image forming process based on electrophotography by using developer such as toner, in particular, relating to an image forming apparatus capable of exchanging a toner container storing toner.

(2) Description of the Prior Art

In the image forming apparatus such as a multifunction machine or the like, the image forming process has a developing process in which an electrostatic latent image on a photosensitive drum is developed with toner in a developing unit, a transfer process in which the toner image is transferred on a sheet, and a fixing process in which the toner image is fixed to the sheet in a fixing portion.

Since the toner need to perform the image forming process, proposed are various techniques for performing a display control of remaining toner and a detection control of remaining toner.

Regarding the detection of the remaining toner, in Patent Document 1, photosensors are installed inside a developing tank in a developing unit, and the remaining toner information is detected by the photosensors and displayed in a display such as an operation panel.

However, being based on the information of amount of toner in the developing tank, there is a time that it becomes unclear whether the toner in a toner cartridge (toner storing container) is used up or not, and it is impossible to completely prevent the toner in the toner cartridge from remaining.

In spite of the fact that the toner in the toner storing cartridge is not used up, a user judges that the toner has been used up, and the user exchanges the toner cartridge to new one. As a result, the remaining toner in the exchanged toner cartridge is threw away.

Therefore, in the conventional manner, there was a problem that the toner is not used up by the user.

As to the problem, desired is a method for making the user recognize the remaining toner within the toner cartridge visually and easily and requested is a technic with which the user can confirm that the toner within the toner cartridge is used up to the end. However, an effective technique was not suggested conventionally.

There is no scheme for reducing the remaining toner, there is no scheme for detecting the remaining toner exactly, and there is no scheme that it is prevented the toner cartridge from being drawn until the toner is used up. As a result, it is necessary for the user to absolutely perform a drawing operation for drawing the toner cartridge at each image forming operation in order to visually confirm how much of the remaining quantity of toner.

As a matter of course, since it is impossible to perform the drawing operation during a printing process, the drawing operation must be done except when the printing process is being performed, causing inconvenience.

PRIOR ART DOCUMENTS

Patent Document

Patent Document 1

Japanese Patent Application Laid-open HEI 7-261537

SUMMARY OF THE INVENTION

The present invention has been devised in view of the above conventional problem, it is therefore an object of the present invention to provide an image forming apparatus in which it is possible for a user to use up the remaining toner in the toner storing container.

The image forming apparatus according to the present invention comprises:

a developing portion;

a toner storing container; and a supply path capable of supplying toner to the developing portion from the toner storing container, wherein the toner storing container is attachably and detachably provided to the supply path, the toner storing container has:

a screw-like conveying member configured to convey the toner;

a discharge portion configured to discharge the toner toward the supply path; and a first cleaning member arranged at an end portion of the conveying member and configured to clean the discharge portion by scraping the toner on the discharge portion based on a rotation of the conveying member.

In the present invention, it is preferred that the toner storing container is further provided with a photosensor arranged at a position within a circular rotational range of a rotation of the first cleaning member, and the first cleaning member scrapes the toner on the photosensor to clean the photosensor as well as the discharge portion.

In the present invention, it is preferred that the toner storing container is further provided with a shutter member configured in such a manner that when the toner storing container has been attached to the image forming apparatus, the shutter member opens a toner discharge path toward the supply path, and when the toner storing container has been detached from the image forming apparatus, the shutter member closes the toner discharge path, and the shutter member is provided with a window portion being made of transparent or translucent member capable of visual recognition of an inside of the toner discharge path.

In the present invention, it is preferred that the toner storing container is further provided with a second cleaning member configured to clean the window portion by a movement of the shutter member.

Advantages of the Invention

According to the image forming apparatus of the present invention, since arranged at the end portion of the conveying member is the first cleaning member configured to clean the discharge portion by scraping the toner on the discharge portion, the toner on the discharge portion is scraped by the rotation of the conveying member. Thus, the discharge portion with the toner is cleaned and the toner is consumed surely. Therefore, it is possible to obtain an advantage that there is no remaining toner within the toner storing container.

DESCRIPTION OF THE PREFERRED EMBODIMENTS

Now, the mode for carrying out the image reading apparatus of the present invention will be described with reference to the drawings.

Figure 1:
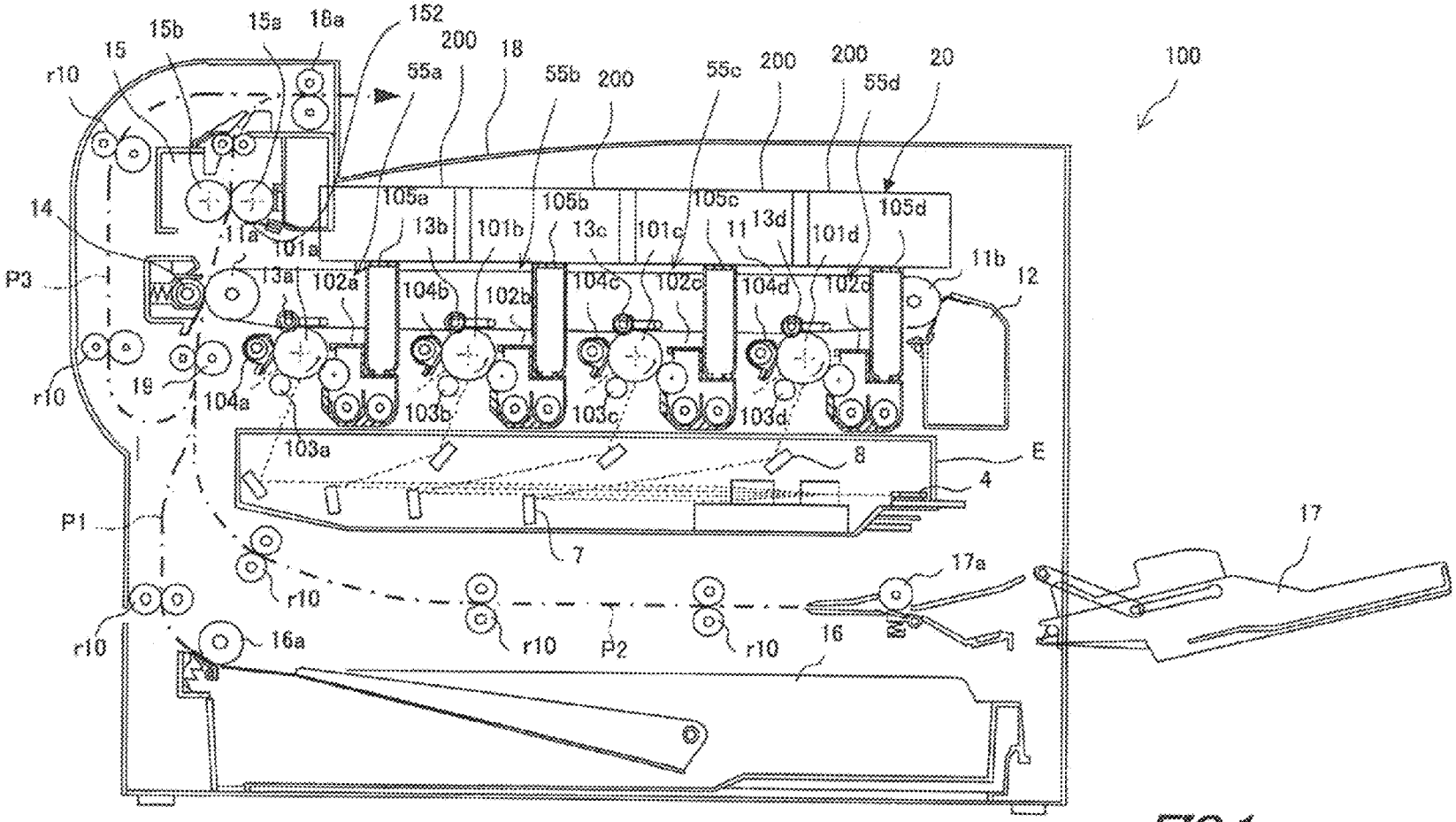
FIG. 1 is an illustrative view showing the overall configuration of an image forming apparatus according to a first embodiment of the present invention.
Figure 2:
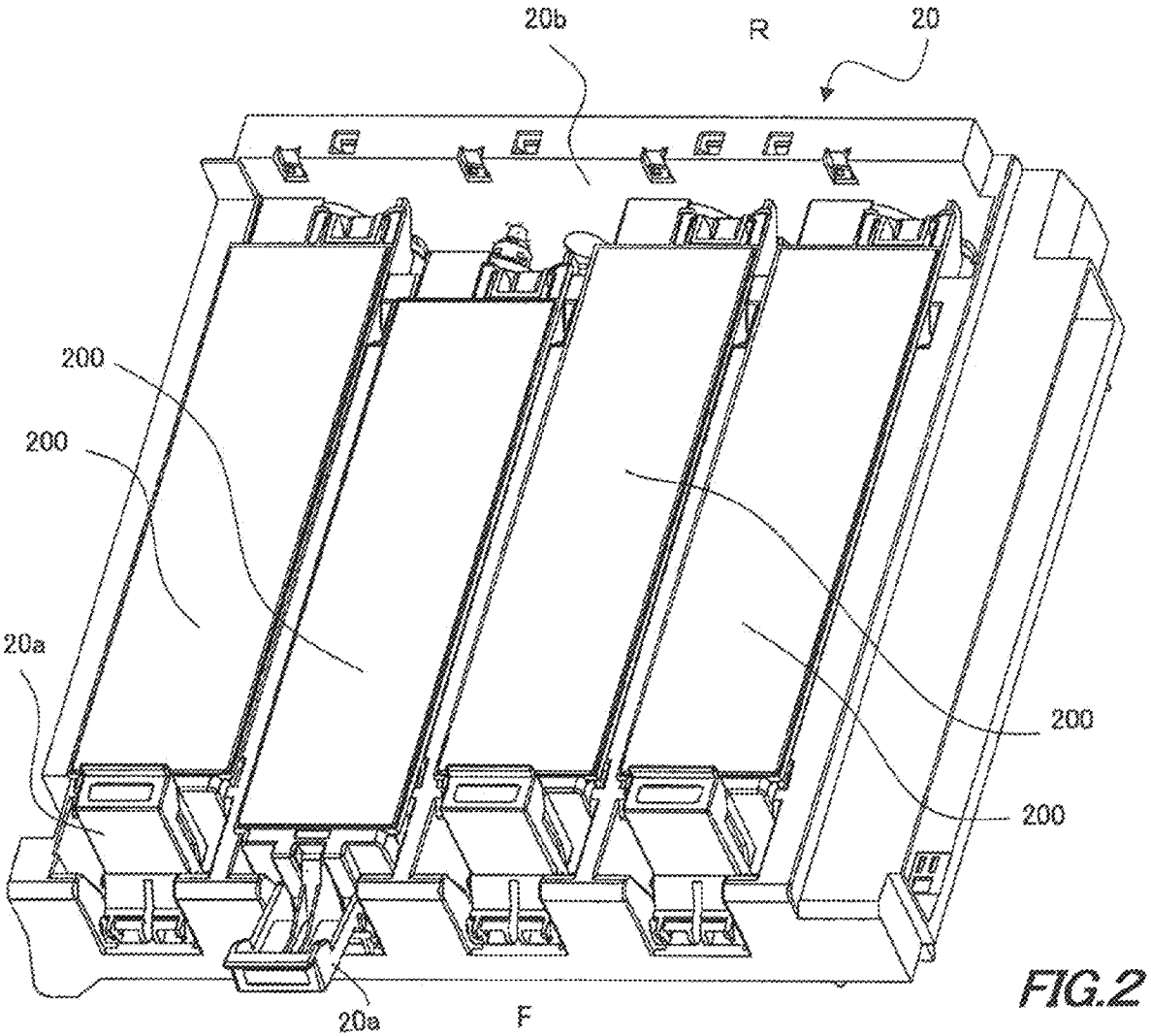
FIG. 2 is a perspective view showing a toner cartridge unit including toner cartridges (toner storing containers) mounted in the image forming apparatus.

FIG. 1 is the illustrative view showing the overall configuration of the image forming apparatus according to the first embodiment of the present invention. FIG. 2 is an illustrative view of the toner cartridge unit. FIGS. 3 to 5 are illustrative views of the toner cartridge.

To being with, the overall configuration of image forming apparatus will be described.

As shown in FIG. 1, the image forming apparatus of the present embodiment forms a multi-colored or monochrome image on a sheet in accordance with image data readout from original copy or image data transmitted from the outside by way of a communication network or the like. Therefore, the image forming apparatus includes: as shown in FIG. 1, an exposure unit E; photosensitive drums 101*a* to 101*d* (which may also be referred to as "photosensitive drums 101" totally); developing units 102*a* to 102*d* (which may also be referred to as "developing units 102" totally); charging rollers 103*a* to 103*d* (which may also be referred to as "charging rollers 103" totally); cleaning units 104*a* to 104*d* (which may also be referred to as "cleaning units 104" totally); intermediate transfer belt 11; primary transfer rollers 13*a* to 13*d* (which may also be referred to as "primary transfer rollers 13" totally); secondary transfer roller 14; fixing unit 15; paper feed paths P1, P2 and P3; a paper feed cassette 16; a manual paper feed tray 17; a paper output tray 18, and the like.

The image forming apparatus performs an image forming process in image forming portions 55*a* to 55*d* (which may also be referred to as "image forming portions 55" totally) by using image data corresponding to four colors, i.e., black (K), cyan (C), magenta (M) and yellow (Y) wherein cyan (C), magenta (M) and yellow (Y) are three primary colors of a subtractive mixture colors obtained by color separation of color image.

All the image forming portions 55*a* to 55*d* have the same configurations, for example black image forming portion 55*a* is composed of photosensitive drum 101*a*, developing unit 102*a*, charging roller 103*a*, transfer roller 13*a* and cleaning unit 104*a* and the like. These image forming portions 55*a* to 55*d* are arranged side by side in the moving direction of intermediate transfer belt 11 (in the sub scan direction).

Charging roller 103 is a charging device of a contact type which uniformly electrifies the photosensitive drum 101 surface at a predetermined potential. A contact type charging device using a charging brush or noncontact type charging device using a charging wire also can be used instead of charging roller 103.

Exposure unit E as the light exposure device in the present embodiment includes an unillustrated semiconductor laser, a polygon mirror 4, a first reflecting mirror 7 and a second reflecting mirror 8, and illuminates photosensitive drums 101*a* to 101*d* with light beams, i.e., laser beams, that are modulated based on image data of separate colors, that is, black, cyan, magenta and yellow.

Electrostatic latent images corresponding to separate color image data of black, cyan, magenta and yellow are formed on photosensitive drums 101*a* to 101*d*, respectively.

Developing unit 102 supplies toner to a surface of the photosensitive drum 101 with an electrostatic latent image formed thereon to develop the electrostatic latent image into a toner image. Developing units 102 (102*a* to 102*d*) store black, cyan, magenta and yellow color toners, respectively so as to develop the electrostatic latent images for individual colors formed on photosensitive drums 101*a* to 101*d* into toner images of black, cyan, magenta and yellow colors.

Individual color toners are supplied from individual color toner cartridges 200 to individual developing units 102*a* to 102*d* through the toner supply paths 105*a* to 105*d*.

Toner supply paths 105*a* to 105*d* are arranged at such positions as to opposite to toner discharge ports of toner cartridges 200 when toner cartridges 200 have been mounted in a toner cartridge unit 20 as shown in FIG. 2. Details of toner cartridge unit 20 and toner cartridge 200 will be described later.

Developing units 102*a* to 102*d* are arranged under toner supply paths 105*a* to 105*d* so that individual color toners are supplied from individual color toner cartridges 200 to developing units 102*a* to 102*d* through toner supply paths 105*a* to 105*d*. A full-color toner image is formed on an intermediate transfer belt 11 in such a manner that the toner images of individual colors are successively transferred one over the other on intermediate transfer belt 11.

Cleaning units 104 remove and collects the toner remaining on the surfaces of photosensitive drums 101 after development and image transfer.

Intermediate transfer belt 11 is arranged over photosensitive drums 101, and wound and tensioned between a drive roller 11*a* and a driven roller 11*b*, forming a loop-like moving path. Arranged opposite to the outer peripheral surface of intermediate transfer belt 11 are photosensitive drum 101*d*, photosensitive drum 101*c*, photosensitive drum 101*b* and photosensitive drum 101*a* in the order mentioned. Primary transfer rollers 13*a* to 13*d* are arranged at positions opposite to respective photosensitive drums 101*a* to 101*d* with this intermediate transfer belt 11 held therebetween. The areas where intermediate transfer belt 11 is opposite to photosensitive drums 101*a* to 101*d* form respective primary transfer positions. Intermediate transfer belt 11 is formed of a film having a thickness of about 100 to 150 μm.

In order to transfer the toner images carried on the surfaces of photosensitive drums 101*a* to 101*d* to intermediate transfer belt 11, each of primary transfer rollers 13*a* to 13*d* is applied by constant-voltage control at a primary transfer bias that has the opposite polarity to that of the static charge on the toner. With this arrangement, the toner images of individual colors formed on photosensitive drums 101 (101*a* to 101*d*) are successively transferred one over the other to the outer peripheral surface of intermediate transfer belt 11 so that a full-color toner image is formed on the outer peripheral surface of intermediate transfer belt 11.

If image data involving only part of colors of yellow, magenta, cyan and black is input, among the four photosensitive drums 101*a* to 101*d*, electrostatic latent images and hence toner images are formed only for the photosensitive drums 101 that correspond to the colors of the input image data.

Each of primary transfer rollers 13*a* to 13*d* is composed of a shaft formed of metal (e.g., stainless steel) having a diameter of 8 to 10 mm and a conductive elastic material (e.g., EPDM, foamed urethane, etc.,) coated on the shaft surface, and uniformly applies a high voltage to intermediate transfer belt 11 through the conducive elastic material.

The toner image transferred to the outer peripheral surface of intermediate transfer belt 11 at each primary transfer position is conveyed as intermediate transfer belt 11 circulates to the secondary transfer position where the belt is opposite to secondary transfer roller 14.

During image forming, secondary transfer roller 14 is abutted with a predetermined nip pressure against the outer peripheral surface of intermediate transfer belt 11, in the area where the interior side of intermediate transfer belt 11 is supported by drive roller 11*a*.

When the paper fed from paper feed cassette 16 or manual paper feed tray 17 passes through the nip between secondary transfer roller 14 and intermediate transfer belt 11, a high voltage of a polarity opposite to the polarity of the static charge on the toner is applied to secondary transfer roller 14. Thereby, toner images are transferred from the outer surface of intermediate transfer belt 11 to the surface of paper.

Since, of the toner adhering to intermediate transfer belt 11 as the belt comes in contact with photosensitive drums 101, the toner which has not been transferred from intermediate transfer belt 11 to the paper during transfer of the toner image and remains on intermediate transfer belt 11 would cause contamination of color toners at the next operation, it is removed and collected by a cleaning unit 12.

The paper with the toner image as a visual image transferred thereon is lead to fixing unit 15 and undergoes heating and pressing processes while passing through and between heat roller 15*a* and pressing roller 15*b*. Thereby, the toner image is firmly fixed to the paper surface. The paper with the toner image fixed thereon is discharged by a paper discharge roller 18*a* onto paper output tray 18.

Image forming apparatus includes a paper feed path P1 that extends approximately vertically to convey the paper stored in paper feed cassette 16 to paper output tray 18 by way of the nip between secondary transfer roller 14 and intermediate transfer belt 11 and fixing unit 15.

Arranged along paper feed path P1 are a pickup roller 16*a* for delivering the paper from paper feed cassette 16, one sheet at a time, into paper feed path P1, conveying rollers r10 for conveying the delivered paper upwards, a registration roller 19 for leading the conveyed paper to the nip between secondary transfer roller 14 and intermediate transfer belt 11 at a predetermined timing and paper discharge roller 18*a* for discharging the paper to paper output tray 18.

Image forming apparatus 100 also incorporates a paper feed path P2 that extends from manual paper feed tray 17 to registration roller 19, having a pickup roller 17*a* and conveying rollers r10 arranged therealong. There is also another paper feed path P3 that extends from paper discharge roller 18*a* toward the upstream side of registration roller 19 in paper feed path P1.

Paper discharge roller 18*a* is adapted to be rotatable in both forward and reverse directions, and is rotated in the forward direction to discharge the paper to paper output tray 18 at the time of one-sided image forming for forming an image on one side of the paper and at the time of the second side image forming in duplex image forming for forming images on both sides of the paper.

On the other hand, at the time of the first side image forming in duplex image forming, paper discharge roller 18*a* is driven in the forward direction until the rear end of the paper passes by fixing unit 15 and then rotated in reverse while the roller is holding the rear end of the paper to lead the paper into paper feed path P3. Thereby, the paper with an image formed on the first side only during duplex image forming is lead to paper feed path P1 with its printed face down and its front edge inverted to the rear.

Registration roller 19 leads the paper that has been fed from paper feed cassette 16 or manual paper feed tray 17 or that has been conveyed through paper feed path P3, to the nip between secondary transfer roller 14 and intermediate transfer belt 11 at a timing synchronized with the rotation of intermediate transfer belt 11. For this purpose, registration roller 19 stops rotating when photosensitive drums 101 and intermediate transfer belt 11 start to operate while the paper that was started to be fed or conveyed in advance of rotation of intermediate transfer belt 11 is stopped from moving in paper feed path P1 with its front end abutting against registration roller 19. Thereafter, registration roller 19 starts to rotate at such a timing that the front edge of the paper and the front end of the toner image formed on intermediate transfer belt 11 meet each other at the position where secondary transfer roller 14 and intermediate transfer belt 11 come in press-contact with each other.

Here, when full-color image forming is performed using all the image forming portions 55*a* to 55*d*, primary transfer rollers 13*a* to 13*d* are adapted to abut intermediate transfer belt 11 against respective photosensitive drums 101*a* to 101*d*. On the other hand, when monochrome image forming is performed with image forming portion 55*a* alone, primary transfer roller 13*a* alone is adapted to abut intermediate transfer belt 11 against photosensitive drum 101*a*.

As shown in FIG. 2, toner cartridge unit 20 is provided in a top-open box form, in which four toner cartridges 200 including four color toners, i.e. black (K), cyan (C), magenta (M) and yellow (Y) toners, respectively are accommodated.

Each toner cartridge 200 is formed to be long along a width direction of the intermediate transfer belt. These toner cartridges are disposed side by side along a conveyance direction of the intermediate transfer belt (the direction of arrow B) at respective positions opposite to developing units 102*a* to 102*d*.

Toner cartridge unit 20 includes a stopper plate 20*b* disposed on one end side with respect to the width direction of the intermediate transfer belt so as to position toner cartridges 200, and lock levers 20*a* disposed on the other end side to hold respective toner cartridges 200. Lock lever 20*a* is laid down sideward when toner cartridge 200 is simply put. To mount toner cartridge 200 into toner cartridge unit 20 in a usable manner, lock lever 20*a* is set upright so as to move toner cartridge 200 in the direction of arrow F and hold the toner cartridge by its being abutted against stopper plate 20*b*.

Next, the interior configuration of toner cartridge 200 will be described with reference to FIGS. 3A and 3B. Toner cartridge 200 includes a toner storing portion 206, a toner conveying screw (screw auger) 202, a shutter member (outer shutter) 203, a toner discharger 204, and an agitating paddle 207.

Figure 3A:
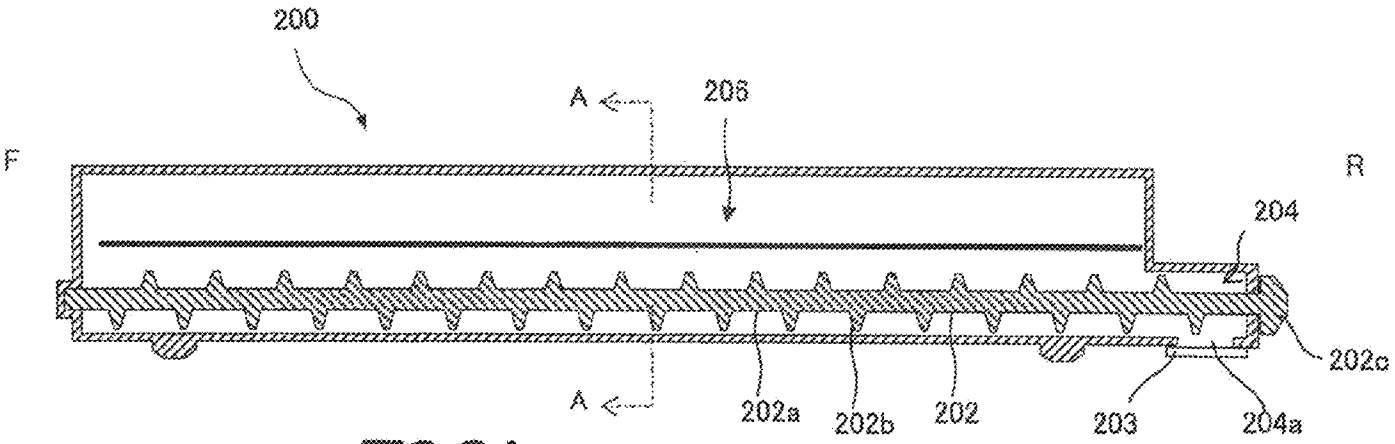
FIG. 3A is a vertical sectional view, cut along an axial direction, showing the toner cartridge.

As shown in FIG. 3A, toner storing portion 206 is formed into a box-shaped form for storing toner therein. In one longitudinal end of toner storing portion 206, toner discharge portion (toner discharging path) 204 is provided, and shutter member 203 is provided on toner discharge portion 204. Meanwhile, as shown in FIG. 3A, a reference numeral F designates a front side (operation side) of image forming apparatus 100, and a reference numeral R designates a rear side of image forming apparatus 100.

Toner conveying screw 202 is arranged in a bottom side of the interior side of toner storing portion 206 in order to convey toner within toner storing portion 206 toward a side of toner discharge portion 204. And, toner conveying screw 202 is provided in such a manner that toner conveying screw 202 is capable of rotating around a rotation central axis along a longitudinal direction of toner conveying screw.

This toner conveying screw 202 includes a rotary shaft 202*a*, a helical blade 202*b* and a drive gear (abbreviated in the figure) as shown in FIG. 3A. Helical blade 202*b* turns so as to convey the toner inside toner storing portion 206 toward toner discharge port 204*a* of toner discharge portion 204. Drive gear is projectively arranged outside toner discharge portion 204 so that the drive gear is rotated by a driving force from an unillustrated motor provided for the image forming apparatus body.

Shutter member 203 is a shutter member for opening and closing toner discharge port 204*a* and is formed of an approximately rectangular plate-like piece, and is arranged so as to be slidable in the longitudinal direction of toner discharge portion 204.

Figure 5B:
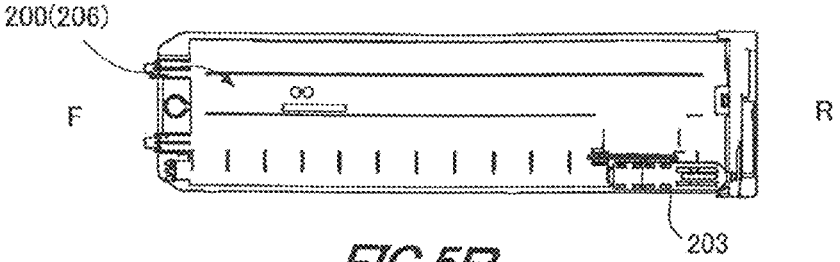
FIG. 5B is a bottom view of the toner cartridge.
Figure 5C:
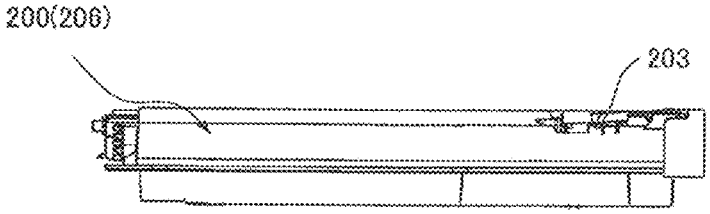
FIG. 5C is a side view of the toner cartridge being turned upside down.
Figure 5A:
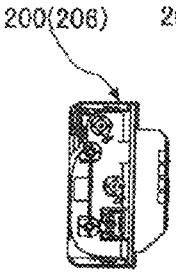
FIG. 5A is a side view of front side (F) of the toner cartridge.
Figure 5D:
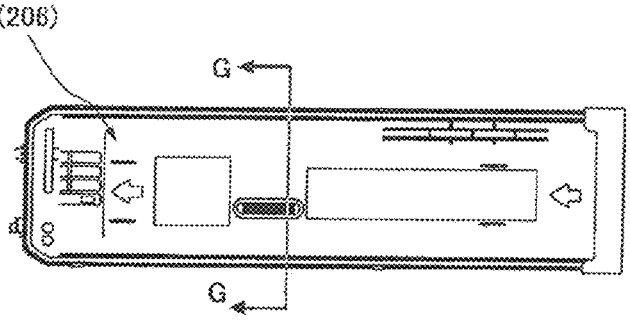
FIG. 5D is a top view of the toner cartridge.
Figure 5F:
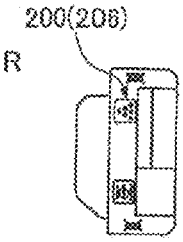
FIG. 5F is a side view of rear side (R) of the toner cartridge.
Figure 5E:
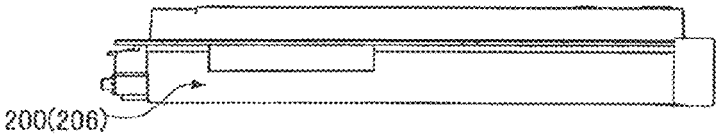
FIG. 5E is a side view of the opposite side of FIG. 5C.
Figure 5G:
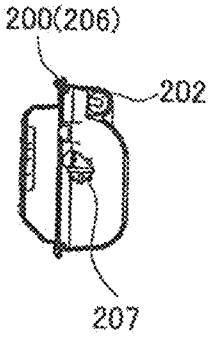
FIG. 5G is a sectional view cut along an arrow line G-G in FIG. 5D.
Figure 5H:
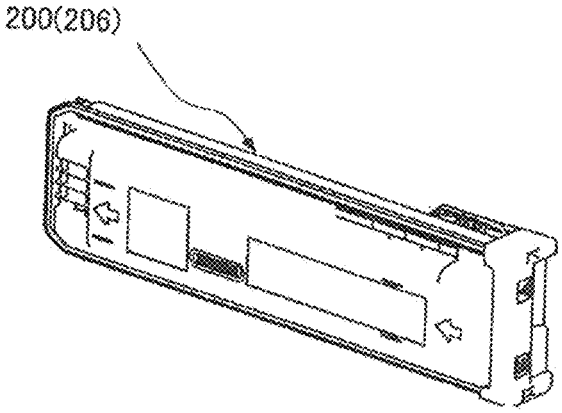
FIG. 5H is a perspective view of the toner cartridge.
Figure 6:
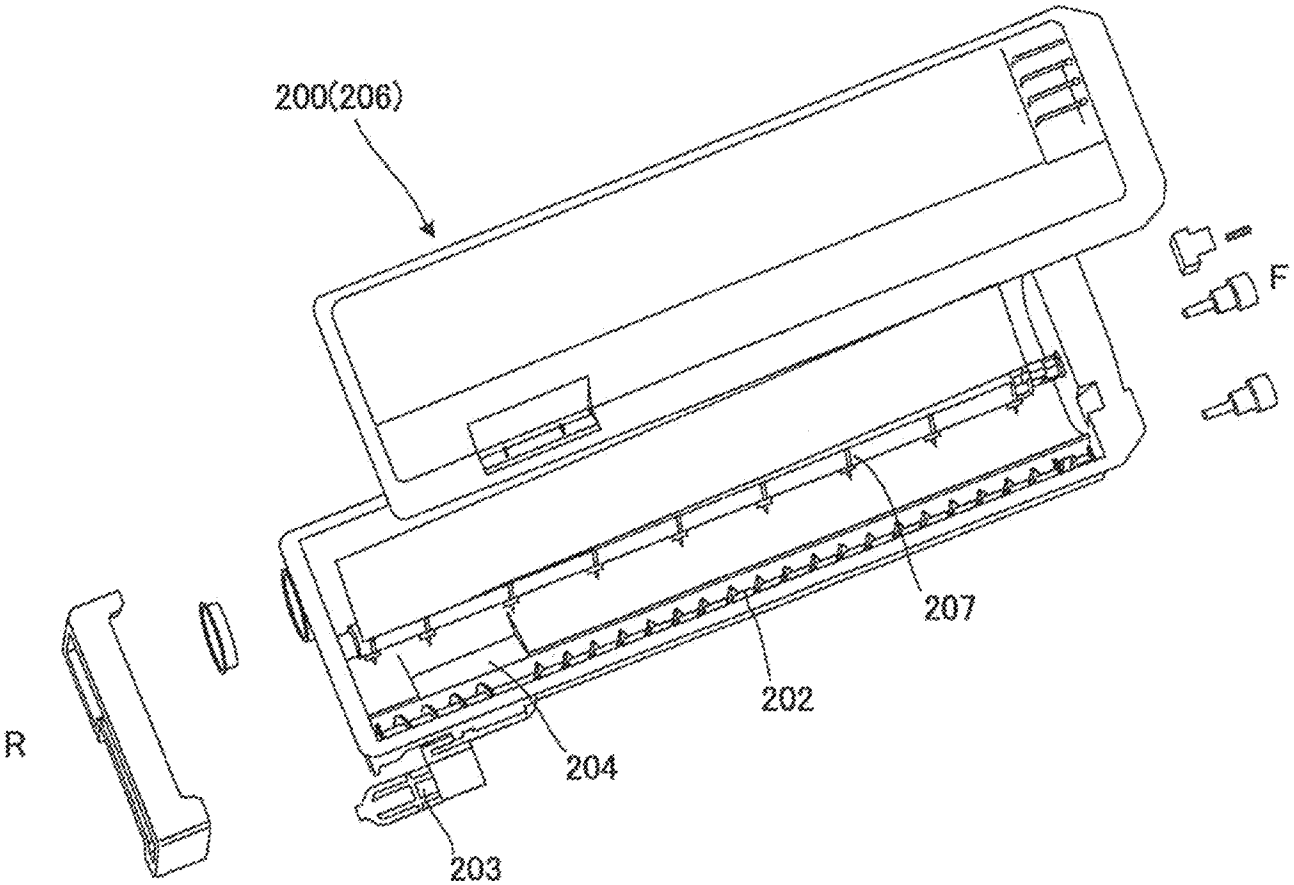
FIG. 6 is an exploded view in perspective of the toner cartridge.

FIGS. 5A to 5H show appearance form of toner container 200 and FIG. 6 is the exploded view of the toner cartridge 200.

As shown in FIGS. 5A to 5H showing appearance, toner cartridge 200 has an approximately box-shaped form, and has a shell structure attaching outer case bodies up and down as shown to the exploded view of FIG. 6 to form the toner storing portion 206 for storing toner in an interior space thereof. In the interior space, toner conveying screw 202 and agitating paddle 207 are arranged. Discharge port 204*a* of toner discharge portion 204 is located on an undersurface of one end side portion (end side portion of rear (R) side in this embodiment case) along an axial direction of the toner cartridge. Meanwhile, FIG. 5B shows a rear R and front F. Also, outer shutter 203 is provided on a bottom portion of the toner cartridge.

Toner discharge portion 204 is a toner discharging path forming an opening from the interior of toner storing portion 206 toward outside so as to pass the toner stored in toner storing portion 206 toward discharge port 204*a*.

As mentioned above, the image forming apparatus is provided with toner cartridges (toner storing container) 200 for supplying the toner to developing units (developing portions) 102*a* to 102*d* in such a manner that toner cartridges (toner storing container) 200 is attachable and detachable to the toner supply paths 105*a* to 105*d*.

In the image forming apparatus of the first embodiment, each toner cartridge 200 has shutter member 203 configured in such a manner that when toner cartridge 200 has been attached to the image forming apparatus, the shutter member opens toner discharge port 204*a* of toner discharge portion 204 toward each of toner supply paths 105*a* to 105*d*, and when toner cartridge 200 has been detached from the image forming apparatus, the shutter member closes toner discharge port 204*a*.

Shutter member 203 performs the opening-closing operation along an axial direction of toner conveying screw 202.

Shutter member 203 is urged by an unillustrated spring member or the like to a position where shutter member 203 closes toner discharge port 204*a* in a state (usual state) that the toner cartridge is not attached to the image forming apparatus.

When toner cartridge 200 has been attached to image forming apparatus 100, shutter member 203 is moved to an opening direction and releases toner discharge port 204*a* in linkage with the attachment action of toner cartridge 200 to become a state that toner cartridge 200 can supply the toner from an upper side of each toner supply paths 105*a* to 105*d*.

Figure 3B:
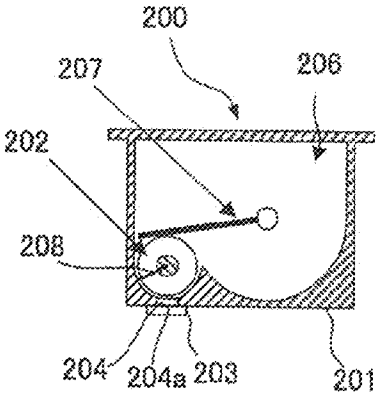
FIG. 3B is a sectional view cut along an arrow line A-A in FIG. 3A.

In the first embodiment, as shown in FIGS. 3A and 3B, each toner cartridge 200 is provided with a screw-like conveying member (toner conveying screw 202) for conveying toner.

As shown in FIG. 3B, each toner cartridge 200 according to the first embodiment is provided with a scraper 208 at an end portion of the conveying member (toner conveying screw 202) as a cleaning member. Scraper 208 rotates together with the conveying member to scrape the toner on the toner discharge port 204*a* of toner discharge portion 204 and clean the toner discharge port 204*a*.

Figure 4A:
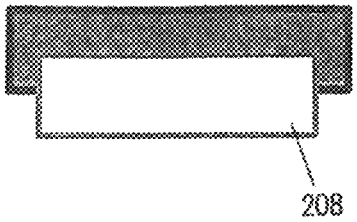
FIG. 4A is a front view showing a scraper 208.

FIG. 4A shows a front view of scraper 208. Scraper 208 is a rectangular shaped sheet having flexibility, for example, may be formed of a polyethylene terephthalate (PET) sheet.

Therefore, when toner conveying screw 202 as a conveying member is operating, the toner discharge port 204*a* of toner discharge portion 204 is cleaned by the rotation of scraper 208 simultaneously. Thus, when conveying the toner, it is possible to definitely clean the around of toner discharge port 204*a* and it is desirable.

Figure 4B:
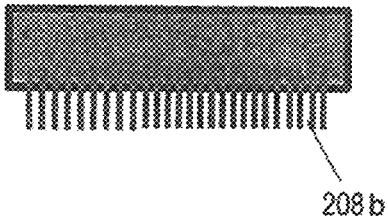
FIG. 4B is a front view showing the other scraper 208*b*.
Figure 4C:
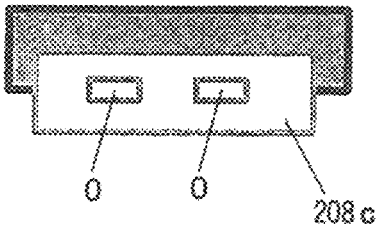
FIG. 4C is a front view showing the other scraper 208*c*.

Meanwhile, the form of scraper 208 is not limited to the rectangular shaped sheet as shown in FIG. 4A, for example, a brush type scraper 208*b* as shown in FIG. 4B can be used. Also, as shown in FIG. 4C, a rectangular shaped sheet scraper 208*c* having one or a plurality of openings O can be used.

Figure 7:
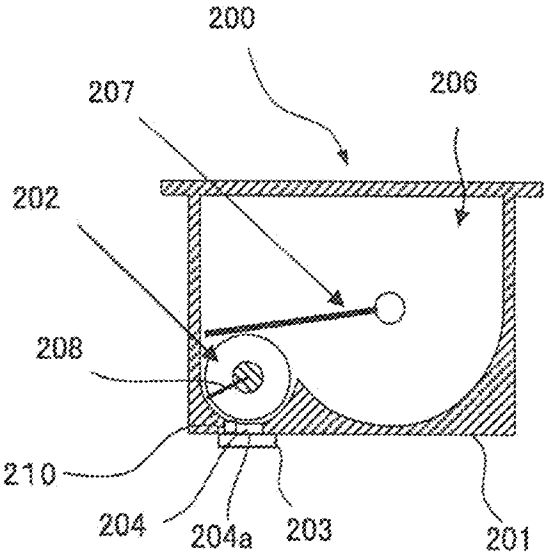
FIG. 7 is sectional view of a toner cartridge of an image forming apparatus according to a second embodiment of the present invention.

FIG. 7 is an illustrative view of a toner cartridge of an image forming apparatus according to a second embodiment of the present invention. Another configurations of the toner cartridge and image forming apparatus are the same as corresponding configurations of the first embodiment.

As shown in FIG. 7, a toner cartridge 200 according to the second embodiment is provided with at least one sensor 210 (for example, photosensor) for detecting toner, the sensor being directed to an inside of the path in toner discharge portion 204. Further, sensor 210 is arranged at a position within a circular rotational range of a rotation of scraper 208.

That is, in the present embodiment, scraper 208 is configured to scrape the toner on toner discharge portion 204 and the toner on the photosensor 210 and clean toner discharge portion 204 and the photosensor 210.

In accordance with the image forming apparatus of the second embodiment, it is possible to detect the remaining toner by using photosensor 210 without depending on visual observation. In the second embodiment, it is possible to detect how much there is toner (the remaining toner) by using the photosensor. Thus, it is possible to reduce the remaining toner without trouble for drawing the toner cartridge.

Next, an image forming apparatus according to a third embodiment will be described.

FIG. 8 is an illustrative view of a toner cartridge of the image forming apparatus according to the third embodiment of the present invention.

The image forming apparatus according to the third embodiment is provided with a window portion 203*a* in shutter member 203 of toner cartridge 200, the window portion 203*a* being made of transparent or translucent member capable of visual recognition of an inside of toner discharge portion 204. Another configurations are the same as the first embodiment.

Figure 8B:
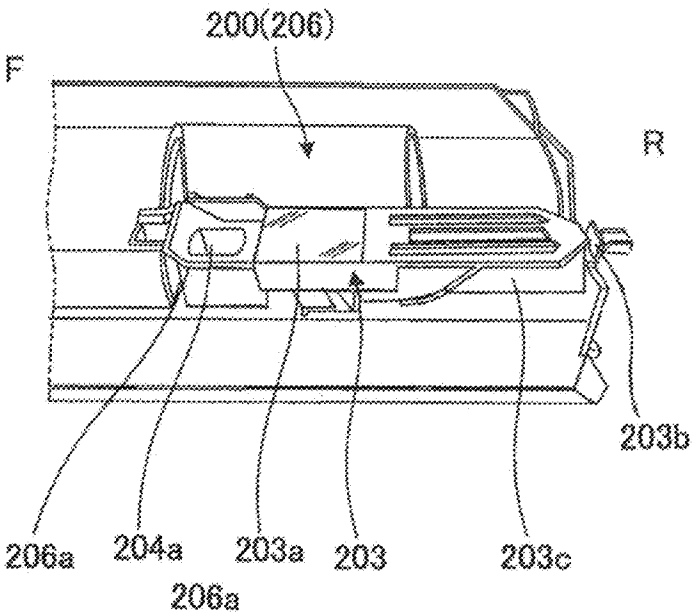
FIG. 8B is an illustrative view showing a state that opened is the shutter member of the toner cartridge of the image forming apparatus according to the third embodiment of the present invention.
Figure 8A:
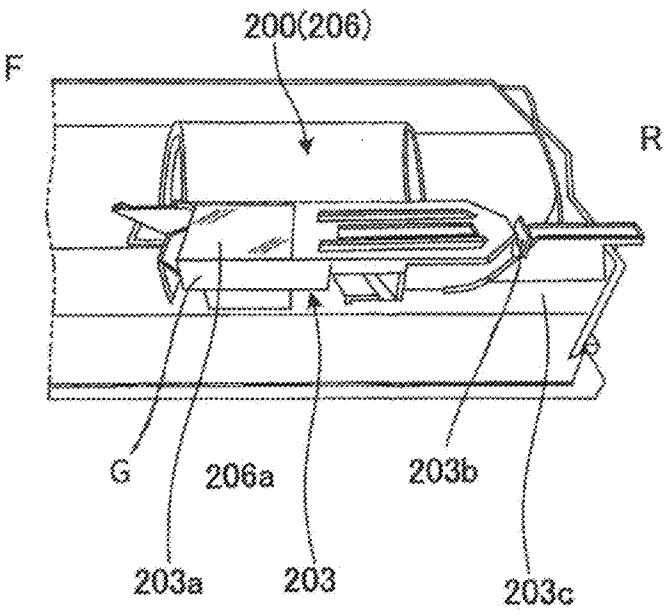
FIG. 8A is an illustrative view showing a state that closed is a shutter member of a toner cartridge of an image forming apparatus according to a third embodiment of the present invention.

FIGS. 8A and 8B show a state of closing of toner cartridge 200 and a state of opening of toner cartridge 200, respectively.

As shown in FIGS. 8A and 8B, shutter member 203 performs the opening-closing operation by sliding on a slider base portion S arranged on an undersurface of toner storing portion 206.

Shutter member 203 is in the state of FIG. 8A when closing, and moves to a direction designated by the numeral R as shown in FIG. 8B and becomes an opening state.

Specifically, as shown in FIG. 8A, shutter member 203 is formed in an approximately rectangular shape having a longitudinal direction along a sliding direction (F-R direction in FIGS. 8A and 8B). The window portion 203*a* is arranged in shutter member 203 such a manner that window portion 203 covers toner discharge port 204*a* in the closing state of the shutter member.

Also, shutter member 203 has a guided portion 203*b* arranged at a leading edge portion with respect to an opening direction (a direction designated by the numeral R), and the flat rectangular window portion 203*a* arranged at a side regarding a closing direction (a direction designated by the numeral F). Window portion 203*a* is made of transparent or translucent member in order to be able to see the toner in toner discharge portion 204.

On an outer side bottom portion of toner storing portion 206, arranged is a rail-like shutter guide portion 203*c* on which guided portion 203*b* can slide.

Also, as shown in FIG. 8B, toner discharge port 204*a* is arranged so as to form an opening on a projected portion 206*a* projected sleeve-like from the outer side bottom portion of toner storing portion 206. A through hole (toner discharging path) is formed in the projected portion 206*a* as toner discharge portion (toner discharging path) 204 and is communicated with the interior of toner storing portion 206. The opening of the through hole becomes toner discharge port 204*a*. Periphery of the opening 204*a* of the sleeve-like projected portion 206*a* is enlarged in a diameter so as to form a flange.

Shutter member 203 is formed with a bracket-like guide member G arranged on both of sides of window portion 203*a* or one side of window portion 203*a* with respect to the sliding direction of window portion 203*a*. And, while guide member G is guided by the flange of the sleeve-like projected portion 206*a*, shutter member 203 slides.

In accordance with the configuration of the shutter guide portion 203*c* and sleeve-like projected portion 206*a*, when opening and closing the shutter member 203, guide member G is guided by the flange of the sleeve-like projected portion 206*a* and guided portion 203*b* is guided by shutter guide portion 203*c*. Therefore, it becomes possible for shutter member 203 to smoothly open and close with respect to the front-rear direction without rattling.

Figure 9:
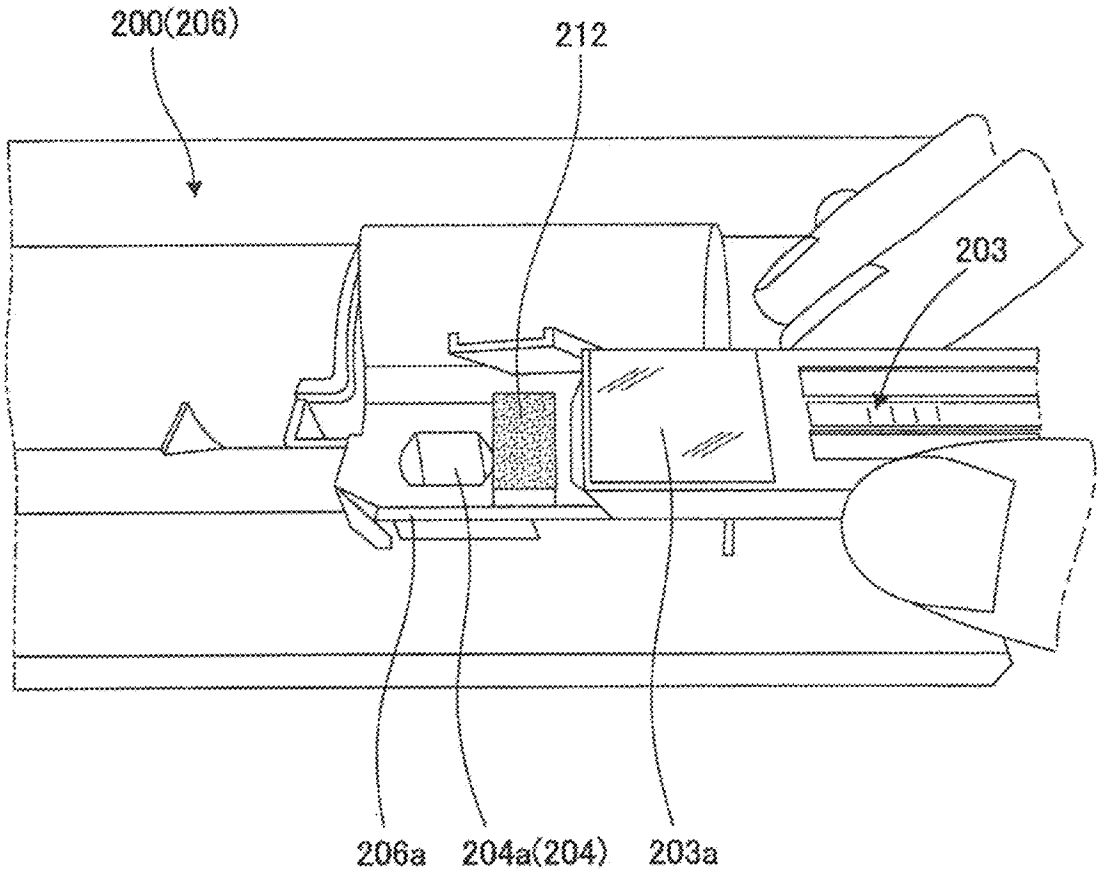
FIG. 9 is an illustrative view of a toner cartridge of an image forming apparatus according to a fourth embodiment of the present invention.

In accordance with the image forming apparatus of the third embodiment, since shutter member 203 has the window portion made of transparent or translucent member capable of seeing the path within toner discharge portion 204, obtained is an advantage that it is possible to visually confirm the remaining toner in the path within toner discharge portion 204 and toner cartridge 200 easily. FIG. 9 is the illustrative view of the toner cartridge of the image forming apparatus according to the fourth embodiment of the present invention. Another configurations are the same as the image forming apparatuses according to the first and second embodiments.

As shown in FIG. 9, a toner cartridge 200 according to the fourth embodiment has a shutter member on projected portion 206*a* as well as the toner cartridge according to the third embodiment, and in addition, has the other cleaning member 212 for cleaning window portion 203*a* by opening and closing operation of shutter member 203.

Specifically, as shown in FIG. 9, on a rear side R of projected portion 206*a*, for example, cleaning member 212 made of sponge is arranged at a position where cleaning member 212 comes into contact with shutter member 203.

By a movement of shutter member 203 when shutter member 203 opens or the like, cleaning member 212 can sweep and remove the toner adhering to a surface of window portion 203*a*, the surface being facing to the interior side of toner cartridge 200.

Therefore, in the image forming apparatus according to the fourth embodiment, by cleaning member 212, it is possible to clean the surface of window portion 203*a* of shutter member 203, the surface of window portion 203*a* adhering the toner.

Also, when toner cartridge 200 is attached to or detached from the image forming apparatus, shutter member 203 works. At that time, since cleaning member 212 can clean window portion 203*a*, it is possible to ensure visibility of window portion 203*a*. Therefore, it is possible to visually confirm an existence of the remaining toner and the amount of the remaining toner surely.

The present invention is not limited to the above embodiments, various changes can be made within the scope of the appended claims. For example, the cleaning member of the toner discharge portion is not limited to scraper 208, and may be formed by an elastic member such as sponge. The mounting position of the cleaning member (scraper 208) also is not limited to the edge portion of the conveying member (toner conveying screw 202), and may be changed variously, such as providing it to another driving mechanism.

INDUSTRIAL APPLICABILITY

The image forming apparatus of the present invention can be adapted, in addition to the image forming apparatus of the above mentioned embodiments, to a main body of an image forming apparatus without providing the toner cartridge unit or to an image forming apparatus having an toner cartridge (toner storing portion) capable of attaching to and detaching from the developing portion.

DESCRIPTION OF REFERENCE NUMERALS

55*a* to 55*d* image forming apparatuses
102*a* to 102*d* developing units
105*a* to 105*d* toner supply paths
20 toner cartridge unit
200 toner cartridge (toner storing container)
202 toner conveying screw
203 shutter member
203*a* window portion
204 toner discharge portion
204*a* toner discharge port
206 toner storing portion
208 cleaning member
210 photosensor
212 the other cleaning member

What is claimed is:

1. An image forming apparatus comprising:
a developing portion;
a toner storing container; and
a supply path configured to supply toner to the developing portion from the toner storing container,
wherein
the toner storing container is attachably and detachably provided to the supply path,
the toner storing container has:
a screw-like conveying member configured to convey the toner;
a discharge portion configured to discharge the toner toward the supply path; and
a first cleaning member arranged at an end portion of the conveying member and configured to clean the discharge portion by scraping the toner on the discharge portion based on a rotation of the conveying member
wherein the toner storing container is further provided with a shutter member configured in such a manner that when the toner storing container has been attached to the image forming apparatus, the shutter member opens a toner discharge path toward the supply path, and when the toner storing container has been detached from the image forming apparatus, the shutter member closes the toner discharge path, and
the shutter member is provided with a window portion being made of transparent or translucent member capable of visual recognition of an inside of the toner discharge path.

2. The image forming apparatus according to claim 1, wherein the toner storing container is further provided with a photosensor arranged at a position within a circular rotational range of a rotation of the first cleaning member, and
the first cleaning member scrapes the toner on the photosensor to clean the photosensor as well as the discharge portion.

3. The image forming apparatus according to claim 1, wherein the toner storing container is further provided with a second cleaning member configured to clean the window portion by a movement of the shutter member.

4. The image forming apparatus according to claim 2, wherein the toner storing container is further provided with a second cleaning member configured to clean the window portion by a movement of the shutter member.

* * * * *